US009541865B2

(12) United States Patent
Tanaka

(10) Patent No.: US 9,541,865 B2
(45) Date of Patent: Jan. 10, 2017

(54) IMAGE FORMING APPARATUS WITH A CONTROLLER TO CONTROL AN ALTERNATING TRANSFER BIAS

(71) Applicant: Shinya Tanaka, Kanagawa (JP)

(72) Inventor: Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/040,215

(22) Filed: Feb. 10, 2016

(65) Prior Publication Data

US 2016/0246218 A1 Aug. 25, 2016

(30) Foreign Application Priority Data

Feb. 24, 2015 (JP) ..... 2015-034545

(51) Int. Cl.
*G03G 15/16* (2006.01)

(52) U.S. Cl.
CPC ..... *G03G 15/1665* (2013.01)

(58) Field of Classification Search
CPC ..... G03G 21/00; G03G 15/1665
USPC ..... 399/72, 66
See application file for complete search history.

(56) References Cited

U.S. PATENT DOCUMENTS 8,626,011 B2 * 1/2014 Yamada ..... G03G 15/161 399/44
2012/0230715 A1 9/2012 Ogino et al.
2012/0237234 A1 9/2012 Sugimoto et al.
2012/0328314 A1 12/2012 Sugimoto et al.
2013/0089363 A1 4/2013 Mimbu et al.
2013/0121714 A1 5/2013 Tanaka et al.
2013/0136468 A1 5/2013 Shimizu et al.
2013/0136477 A1 5/2013 Ogiyama et al.
2013/0142531 A1 6/2013 Sugimoto et al.
2013/0148993 A1 6/2013 Aoki et al.
2013/0164011 A1 6/2013 Nakamura et al.
2013/0177329 A1 7/2013 Tanaka et al.
(Continued)

FOREIGN PATENT DOCUMENTS

JP 2006-267486 10/2006
JP 2013-127592 6/2013
JP 2014-240881 12/2014

OTHER PUBLICATIONS

U.S. Appl. No. 14/881,293, filed Oct. 13, 2015.
U.S. Appl. No. 14/881,611, filed Oct. 13, 2015.

*Primary Examiner* — Quana M Grainger
(74) *Attorney, Agent, or Firm* — Oblon, McClelland, Maier & Neustadt, L.L.P.

(57) ABSTRACT

An image forming apparatus includes an image bearer; a transfer device; a transfer bias power source; and a controller to control the transfer bias power source. The transfer bias power source outputs the voltage that alternates between a transfer-directional voltage and a return-directional voltage. The transfer-directional voltage having a polarity transfers the toner image from a side of the image bearer to a side of the recording medium. The return-directional voltage has an opposite polarity to the polarity of the transfer-directional voltage. The controller reduces a frequency of the output voltage as a value of a ratio of A to B decreases while changing the value of the ratio of A to B. In this case, A is a time period of application of the return-directional voltage within one cycle of the output voltage, and B is a time period of the one cycle of the output voltage.

6 Claims, 8 Drawing Sheets

(56) References Cited

U.S. PATENT DOCUMENTS

| | | | |
|---|---|---|---|
| 2013/0195483 | A1 | 8/2013 | Shimizu et al. |
| 2013/0236201 | A1 | 9/2013 | Mizutani et al. |
| 2013/0308968 | A1 | 11/2013 | Shinya Tanaka et al. |
| 2014/0010562 | A1 | 1/2014 | Tanaka et al. |
| 2014/0029988 | A1 | 1/2014 | Shimizu et al. |
| 2014/0079418 | A1 | 3/2014 | Tanaka et al. |
| 2014/0248064 | A1 | 9/2014 | Tanaka et al. |
| 2014/0314435 | A1 | 10/2014 | Kato et al. |
| 2014/0328603 | A1 | 11/2014 | Mizutani et al. |
| 2014/0328604 | A1 | 11/2014 | Tanaka et al. |
| 2015/0212453 | A1 | 7/2015 | Tanaka |
| 2015/0346650 | A1 | 12/2015 | Kato et al. |

* cited by examiner

FIG. 6

| | RATIO OF A TO B | | | | |
|---|---|---|---|---|---|
| | 0.3 | 0.2 | 0.15 | 0.10 | 0.05 |
| COMPARATIVE EXAMPLE | 1000Hz | 1000Hz | 1000Hz | 1000Hz | 1000Hz |
| EXAMPLE 1 | 1000Hz | 1000Hz | 800Hz | 600Hz | 500Hz |
| EXAMPLE 2 | 500Hz | 500Hz | 400Hz | 400Hz | 400Hz |

FIG. 7

| | RATIO OF A TO B | | | | |
|---|---|---|---|---|---|
| | 0.3 | 0.2 | 0.15 | 0.10 | 0.05 |
| COMPARATIVE EXAMPLE | FAIR | GOOD | GOOD | FAIR | POOR |
| EXAMPLE 1 | FAIR | GOOD | GOOD | EXCELLENT | EXCELLENT |
| EXAMPLE 2 | FAIR | GOOD | GOOD | EXCELLENT | EXCELLENT |

FIG. 8

| A (msec) | EVALUATION OF TRANSFERABILITY IN RECESSED PORTIONS |
|---|---|
| 0.01 | 1 |
| 0.05 | 1 |
| 0.10 | 3 |
| 0.20 | 4 |
| 0.30 | 4 |
| 0.50 | 4 |

IMAGE FORMING APPARATUS WITH A CONTROLLER TO CONTROL AN ALTERNATING TRANSFER BIAS

CROSS-REFERENCE TO RELATED APPLICATION

This patent application is based on and claims priority pursuant to 35 U.S.C. §119(a) to Japanese Patent Application No. 2015-034545, filed on Feb. 24, 2015, in the Japan Patent Office, the entire disclosure of which is hereby incorporated by reference herein.

BACKGROUND

Technical Field

Aspects of the present disclosure relate to an image forming apparatus.

Related Art

In an image forming apparatus that employs an electrophotographic method, a belt type image bearer bearing an image contacts a transfer device opposed to the image bearer to form a transfer nip, thereby transferring a toner image onto a recording medium in the transfer nip. In such a configuration, when using a recording medium having a coarse surface or an embossed surface such as Japanese paper (also known as Washi), a pattern of light and dark (unevenness of image density) according to the surface condition of the recording medium appears in an output image. More specifically, toner does not transfer well to such embossed surfaces, in particular, recessed portions of the surface. This inadequate transfer of the toner appears as a pattern of light and dark in the resulting output image. In view of the above, when a superimposed voltage, in which a direct current voltage is superimposed on an alternating current voltage, is applied as a transfer voltage, the superimposed voltage is applied in a transfer direction for a longer time period than in a direction opposite to the transfer direction to improve the transferability.

SUMMARY

In an aspect of this disclosure, there is provided an image forming apparatus including an image bearer to bear a toner image; a transfer device to contact the image bearer to form a transfer nip; a transfer bias power source to output a voltage to transfer a toner image from the image bearer onto a recording medium in the transfer nip; and a controller to control the transfer bias power source. The transfer bias power source outputs the voltage that alternates between a transfer-directional voltage and a return-directional voltage, to transfer the toner image from the image bearer to the recording medium. The transfer-directional voltage having a polarity transfers the toner image from the image bearer to the recording medium. The return-directional voltage has an opposite polarity to the polarity of the transfer-directional voltage. The controller reduces a frequency of the output voltage as a ratio of A to B decreases. In this case, A is a time period of application of the return-directional voltage within one cycle of the output voltage, and B is a time period of the one cycle of the output voltage.

BRIEF DESCRIPTION OF THE DRAWINGS

The aforementioned and other aspects, features, and advantages of the present disclosure would be better understood by reference to the following detailed description when considered in connection with the accompanying drawings, wherein:

FIG. 6 is a diagram of the relations between variable ratios of a time period of application of an opposite-polarity voltage to a time period of one cycle of a voltage applied, and variable frequencies according to Comparative Example, Example 1, and Example 2;

FIG. 7 is a diagram of evaluation of transferability depending on variable ratios of a time period of application of an opposite-polarity voltage to a time period of one cycle of a voltage applied, and variable frequencies according to Comparative Example, Example 1, and Example 2;

FIG. 8 is a diagram of ranking of transferability on a recess of a recording medium when only the time period of application of the opposite-polarity voltage is varied;

Figure 1:
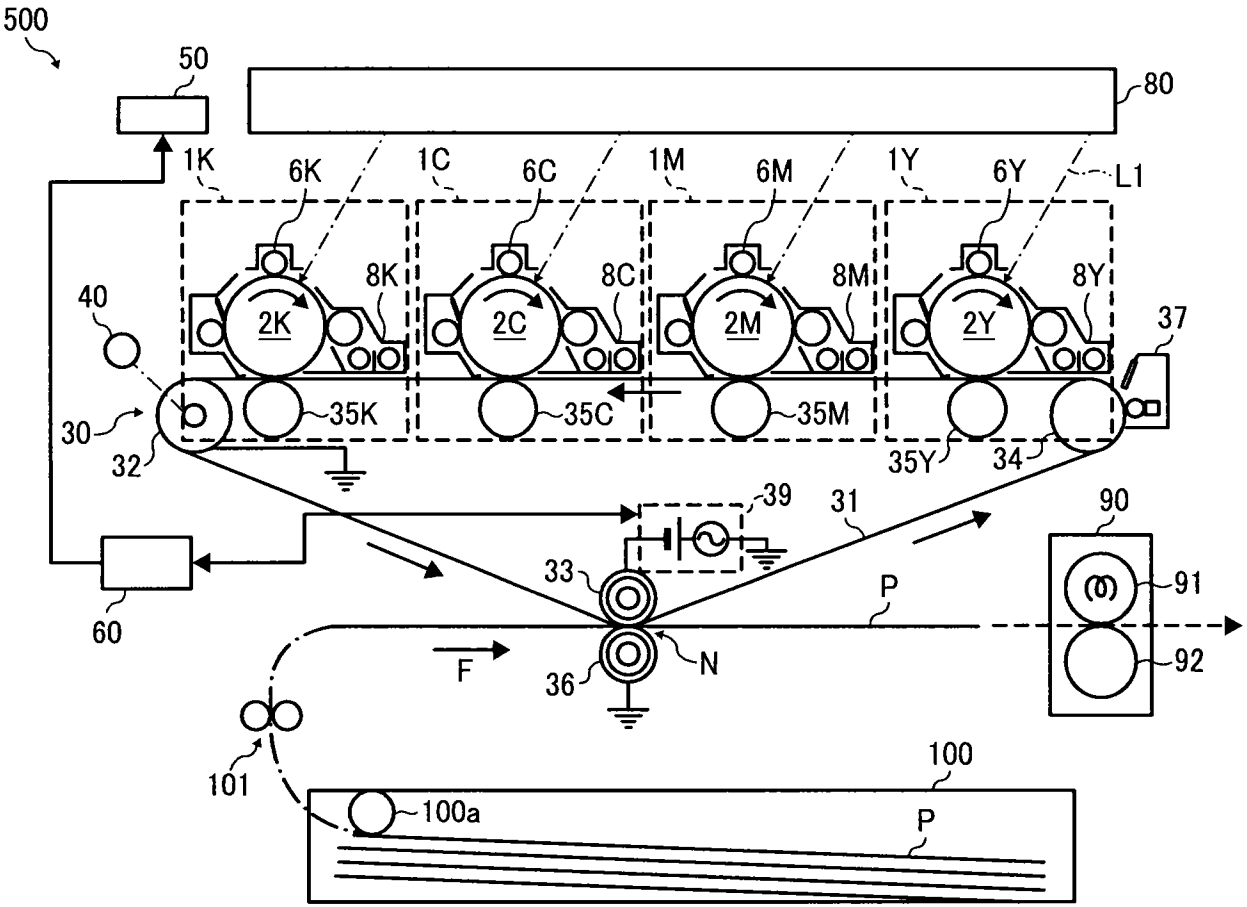
FIG. 1 is a schematic view of an image forming apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

With reference to FIG. 1, a description is provided of an electrophotographic color printer as an example of an image forming apparatus 500 according to a first embodiment of the present disclosure. FIG. 1 is a schematic view of a printer (hereinafter, referred to as the image forming apparatus 500) as an example of an image forming apparatus 500 of the present disclosure. As illustrated in FIG. 1, the image forming apparatus 500 includes four-toner image forming units 1Y, 1M, 1C, and 1K for forming toner images, one for each of the colors yellow, magenta, cyan, and black. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The image forming apparatus 500 includes a transfer unit 30 serving as a transfer device, an optical writing unit 80, a fixing device 90, a paper cassette 100, and a pair of registration rollers 101.

Figure 2:
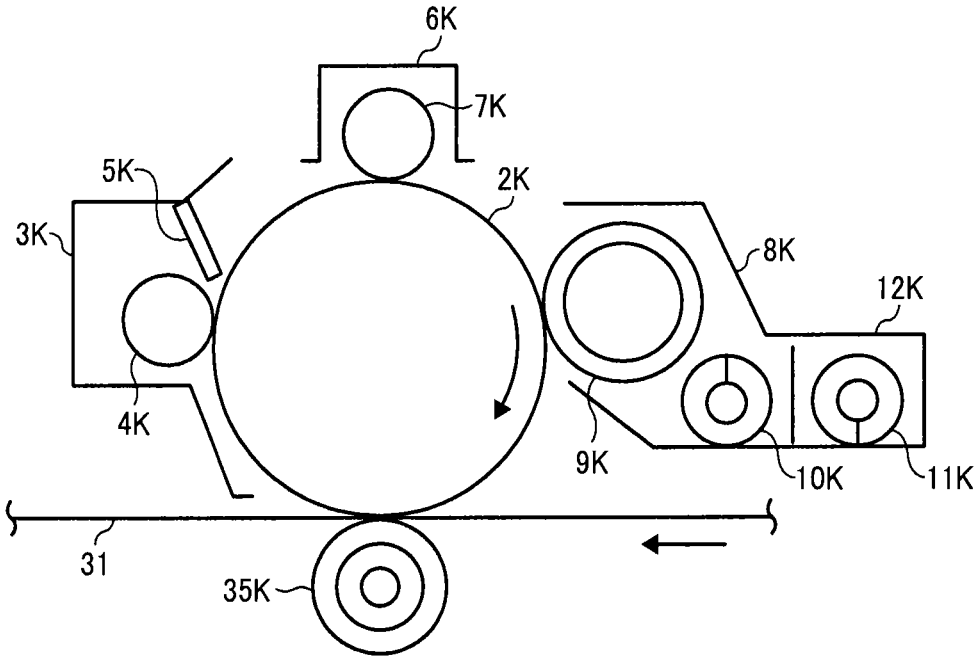
FIG. 2 is an enlarged view of a toner image forming unit for black color as a representative example of toner image forming units employed in the image forming apparatus of FIG. 1.

The toner image forming units 1Y, 1M, 1C, and 1K all have the same configuration as all the others, except for different colors of toner employed. Thus, a description is provided of the toner image forming unit 1K for forming a toner image of black as a representative example of the toner image forming units 1Y, 1M, 1C, and 1K. Thus, a description is provided of the image forming unit 1K for forming a toner image of black as a representative example of the image forming units. As illustrated in FIG. 2, the image forming unit 1K includes a drum-shaped photoconductor 2K as an image bearer, a photoconductor cleaner 3K, a charging device 6K (6C, 6M, and 6Y for the toner image forming units 1C, 1M, and 1Y, respective), and a developing device 8K (8C, 8M, and 8Y for the toner image forming units 1C, 1M, and 1Y, respective). These devices are held in a common casing so that they are detachably installable and replaceable all together relative to the main body. The image forming unit 1K is replaceable independently.

The photoconductor 2K includes a drum-shaped base, on which an organic photosensitive layer is disposed. The photoconductor 2K is rotated in a clockwise direction by a driving device. The charging device 6K includes a charging roller 7K to which a charging bias is applied. The charging roller 7K contacts or is disposed in proximity to the photoconductor 2K to generate electrical discharge between the charging roller 7K and the photoconductor 2K, thereby uniformly charging the surface of the photoconductor 2K. According to the present embodiment, the photoconductor 2K is uniformly charged with a negative polarity, which is the same polarity as the polarity of normally-charged toner. More specifically, the photoconductor 2K is uniformly charged with a voltage of approximately −650 V. As a charging bias, a superimposed voltage, in which an alternating current voltage (an alternating component) is superimposed on a direct current voltage (a direct component) is employed. Instead of using the charging device 6K including the charging roller 7K that contacts or disposed close to the photoconductor 2K, a charging method that employs a corona charger, which does not contact the photoconductor 2K, may be employed.

The surface of the photoconductor 2K uniformly charged by the charging device 6K is scanned by laser light L1 projected from the optical writing unit 80, thereby forming an electrostatic latent image for black on the surface of the photoconductor 2K. The electrostatic latent image for black has a potential of approximately −100 V. The electrostatic latent image for black on the photoconductor 2K is developed with black toner by the developing device 8K. Accordingly, a visible image, also known as a toner image of black, is formed on the photoconductor 2K. As will be described later in detail, the toner image is primarily transferred onto an intermediate transfer belt 31 as an image bearer formed into a belt shape or an intermediate transferor in a process known as a primary transfer process.

The photoconductor cleaner 3K removes residual toner remaining on the surface of the photoconductor 2K after a primary transfer process, that is, after the photoconductor 2K passes through a primary transfer nip between the intermediate transfer belt 31 and the photoconductor 2K. In the photoconductor cleaner 3K, the brush roller 4K rotates and brushes off the residual toner from the surface of the photoconductor 2K while the cleaning blade 5K scraping off the residual toner from the surface of the photoconductor 2K. The static eliminator removes residual charge remaining on the photoconductor 2K, initializing the surface of the photoconductor 2K after the surface thereof is cleaned by the photoconductor cleaner 3K, in preparation for the subsequent imaging cycle.

The developing device 8K includes a developing roller 9K as a developer bearer, a first screw 10K, and a second screw 11K as a developer stirring device. The developing device 8K includes a developing roller 9K as a developer bearer, a first screw 10K, and a second screw 11K as a developer stirring device.

The developing roller 9K is opposed to the photoconductor 2K through an opening formed in the developing casing 12K, to convey toner for black supplied from the first screw 10K to a developing area facing the photoconductor 2K. The developing roller 9K is supplied with a developing bias having the same polarity as that of the toner. The developing bias is greater than the bias of the electrostatic latent image on the photoconductor 2K, but less than the charging potential of the uniformly charged photoconductor 2K. Due to the developing potential and the non-developing potential, the toner on the developing roller 9K selectively moves to the electrostatic latent image formed on the photoconductor 2K, thereby forming a visible image, known as a black toner image.

Similar to the toner image forming unit 1K, toner images of yellow, magenta, and cyan are formed on the photoconductors 2Y, 2M, and 2C of the toner image forming units 1Y, 1M, and 1C, respectively.

Referring back to FIG. 1, the optical writing unit 80 as a latent writing device is disposed above the image forming units 1Y, 1M, 1C, and 1K. Based on image information transmitted from an external terminal, such as a personal computer (PC), the optical writing unit 80 illuminates the photoconductors 2Y, 2M, 2C, and 2K with the laser light L1 projected from a light source, such as a laser diode. Accordingly, the electrostatic latent images of yellow, magenta, cyan, and black are formed on the photoconductors 2Y, 2M, 2C, and 2K, respectively. Alternatively, the optical writing unit 80 may employ, as a latent image writer, an LED array including a plurality of LEDs that project light.

The transfer unit 30 is disposed below the image forming units 1Y, 1M, 1C, and 1K. The transfer unit 30 also includes a drive roller 32, a secondary-transfer back surface roller 33, a cleaning auxiliary roller 34, four primary transfer rollers 35Y, 35M, 35C, and 35K (which may be referred to collectively as primary transfer rollers 35), a nip forming roller 36 as a secondary transfer roller, and a belt cleaning device 37.

The intermediate transfer belt 31 formed into a loop is stretched taut around the drive roller 32, the secondary-transfer back surface roller 33, the cleaning auxiliary roller 34, and the four primary transfer rollers 35Y, 35M, 35C, and 35K, those are disposed inside the loop. The drive roller 32 is rotated in the counterclockwise direction by a drive device, and rotation of the drive roller 32 enables the intermediate transfer belt 31 to rotate in the same direction.

The four primary transfer rollers 35Y, 35M, 35C, and 35K are configured to press against the respective photoconductors 2Y, 2M, 2C, and 2K via the intermediate transfer belt 31 endlessly moving. Accordingly, primary transfer nips are formed between a front surface of the intermediate transfer belt 31 and the photoconductors 2Y, 2M, 2C, and 2K that contact the intermediate transfer belt 31. A primary transfer power source applies a primary transfer bias to the primary transfer rollers 35Y, 35M, 35C, and 35K, thereby forming a transfer electric field between the primary transfer rollers 35Y, 35M, 35C, and 35K, and the toner images of yellow, magenta, cyan, and black formed on the photoconductors 2Y, 2M, 2C, and 2K, respectively. The yellow toner image formed on the photoconductor 2Y enters the primary transfer nip for yellow with rotation of the photoconductor 2Y. Then, the yellow toner image is primarily transferred from the photoconductor 2Y to the intermediate transfer belt 31 by the transfer electric field and the nip pressure. The intermediate transfer belt 31 with the yellow toner image primarily transferred thereon sequentially passes through the primary transfer nips of magenta, cyan, and black in this order. Accordingly, the magenta toner image, the cyan toner image, and the black toner image on the photoconductors 2M, 2C, and 2K are sequentially superimposed on the yellow toner image which has been transferred on the intermediate transfer belt 31, one atop the other in the primary transfer process. Accordingly, a composite toner image, in which the toner images of yellow, magenta, cyan, and black are superimposed one atop the other, is formed on the surface of the intermediate transfer belt 31. Such a composite toner image is formed in a case of multiple color printing. In a case of a single color printing, a toner image of one color is transferred from one photoconductor onto the intermediate transfer belt 31.

The primary transfer rollers 35Y, 35M, 35C, and 35K described above are supplied with a primary transfer bias under constant current control. According to the present embodiment, roller-type primary transfer devices, that is, the primary transfer rollers 35Y, 35M, 35C, and 35K, are employed as primary transfer devices. Alternatively, a transfer charger and a brush-type transfer device may be employed as the primary transfer device.

The nip forming roller 36 is disposed outside the loop formed by the intermediate transfer belt 31, opposed to the secondary-transfer back surface roller 33 which is disposed inside the loop. The intermediate transfer belt 31 is interposed between the secondary-transfer back surface roller 33 and the nip forming roller 36. Accordingly, a secondary transfer nip N is formed between the peripheral surface or the image bearing surface of the intermediate transfer belt 31 and the nip forming roller 36 contacting the surface of the intermediate transfer belt 31. In the example illustrated in FIG. 1, the nip forming roller 36 is grounded. By contrast, a secondary transfer bias power source 39 applies a secondary transfer bias to the secondary-transfer back surface roller 33. With this configuration, a secondary transfer electrical field is formed between the secondary-transfer back surface roller 33 and the nip forming roller 36 so that toner having a negative polarity is electrostatically transferred from the secondary-transfer back surface roller 33 side to the nip forming roller 36 side.

As illustrated in FIG. 1, the paper cassette 100 storing a sheaf of recording media P is disposed below the transfer unit 30. The paper cassette 100 includes a feed roller 100*a* to contact the top sheet of the sheaf of recording media P. The feed roller 100*a* rotates at a predetermined speed to pick up the top sheet of the recording media P and send it to a medium passage. Substantially at the end of the medium passage is disposed the pair of registration rollers 101. The pair of registration rollers 101 is driven to rotate to feed the recording medium P to the secondary transfer nip N in appropriate timing, such that the recording medium P is aligned with the composite toner image or a single-color toner image formed on the intermediate transfer belt 31 contacting the recording medium P in the secondary transfer nip N. In the secondary transfer nip, the recording medium P tightly contacts the composite toner image or the single-color toner image on the intermediate transfer belt 31, and the composite toner image or the single-color toner image is secondarily transferred onto the recording medium P by the secondary transfer electric field and the nip pressure applied thereto, thereby combining with a white color on the recording medium P to form a full-color toner image or a single-color toner image on the surface of the recording medium P.

The fixing device 90 is disposed downstream from the secondary transfer nip N in a direction (indicated by arrow F) of conveyance of the recording medium P. The fixing device 90 includes a fixing roller 91 and a pressing roller 92. The fixing roller 91 includes a heat source inside the fixing roller 91. While rotating, the pressing roller 92 pressingly contacts the fixing roller 91, thereby forming a heated area called a fixing nip therebetween. Under heat and pressure, the toner adhered to the toner image is softened and fixed to the recording medium P having the full-color toner image or the single-color toner image transferred thereon in the fixing nip. After the toner image is affixed to the recording medium P, the recording medium P exits the fixing device 90. Subsequently, the recording medium P goes outside the image forming apparatus 500 through a post-fixing medium path.

After the intermediate transfer belt 31 passes through the secondary transfer nip N, the toner residue not having been transferred onto the recording medium P remains on the intermediate transfer belt 31. The residual toner is removed from the intermediate transfer belt 31 by the belt cleaning device 37 which contacts the front surface of the intermediate transfer belt 31.

In the present embodiment, the power source 39 outputs the secondary transfer bias to transfer a toner image onto the recording medium P disposed in the secondary transfer nip N. The power source 39 includes a direct current (DC) power source and an alternating current (AC) power source to output, as a secondary transfer bias, a superimposed bias, in which an alternating current voltage (an alternating current component) is superimposed on a direct current voltage (a direct current component), or output only the direct current voltage.

An aspect of supplying a secondary transfer bias is not limited to the aspect illustrated in FIG. 1. Alternatively, the power source 39 may apply the superimposed bias to the nip forming roller 36 with the secondary-transfer back surface roller 33 grounded. In this case, the polarity of the DC voltage is changed. That is, as illustrated in FIG. 1, in cases that toner has a negative polarity, and that the superimposed bias is applied to the secondary-transfer back surface roller 33 with the nip forming roller 36 grounded; the DC voltage having the same negative polarity as the toner is applied to the secondary-transfer back surface roller 33 while a time-averaged potential of the superimposed bias has the same negative polarity as the toner.

By contrast, in a case in which the secondary-transfer back surface roller 33 is grounded and the superimposed bias is applied to the nip forming roller 36, the DC voltage having the positive polarity opposite to that of the toner is applied while the time-averaged potential of the superimposed bias has the positive polarity which is opposite to that of the toner.

An another aspect of supplying a secondary transfer bias (the superimposed bias) is not limited to aspects in which the superimposed bias is applied to either one of the secondary-transfer back surface roller 33 and the nip forming roller 36. For example, in some embodiments, one of two separately-disposed power sources applies the DC voltage to either one of the secondary-transfer back surface roller 33 and the nip forming roller 36, and the other power source applies the superimposed voltage to the other roller.

As even another aspect of supplying a secondary transfer bias, either one of the secondary-transfer back surface roller 33 and the nip forming roller 36 is supplied with the secondary transfer bias alternated between the bias including the superimposed voltage, in which the DC voltage is superimposed on the AC voltage, and the bias including only the DC voltage.

As still another aspect of supplying a secondary transfer bias, either one of the secondary-transfer back surface roller 33 and the nip forming roller 36 is supplied with the secondary transfer bias alternated between the bias including the superimposed voltage, in which the DC voltage is superimposed on the AC voltage, and the bias including only the DC voltage. Alternatively, in some embodiments, one of separately-disposed power sources supplies the bias including the superimposed voltage, in which the DC voltage is superimposed on the AC voltage, to either one of the secondary-transfer back surface roller 33 and the nip forming roller 36. The other power source supplies the bias including only the DC voltage to the other roller. The two power sources are switched as appropriate.

There are various aspects of application of the secondary transfer bias to the secondary transfer nip N. As an aspect of a power source, the power source 39 of FIG. 1 supplies the voltage including the superimposed voltage, in which the DC voltage is superimposed on the AC voltage. Alternatively, separate power sources respectively supply the voltage including the superimposed voltage, in which the DC voltage is superimposed on the AC voltage, and the voltage including only the DC voltage. Alternatively, one power source outputs the voltage that alternates between the voltage including the superimposed voltage, in which the DC voltage is superimposed on the AC voltage and the voltage including only the DC voltage. A suitable power source may be selected according to an aspect of application of the secondary transfer bias, as appropriate.

The power source 39 outputs the secondary transfer bias under constant voltage control or constant current control. The constant voltage control refers to controlling the power source 39 to output a constant voltage. The constant current control refers to controlling the power source 39 to output a constant current. For example, the controller 60 controls the power source 39 to output a constant voltage and a constant current.

The power source 39 switches between a direct current transfer mode (a first mode) to output a voltage including only the DC voltage and an alternating current transfer mode (a second mode) to output a voltage including the superimposed voltage, in which the AC voltage is superimposed on the DC voltage. In the image forming apparatus of the present disclosure, switching the output of the AC voltage of the power source 39 ON/OFF allows the power source to switch between the first mode and the second mode. The controller 60 controls such an ON/OFF switching of the output of the AC voltage of the power source 39.

When using a normal sheet of paper, such as the one having a relatively smooth surface, without using a recording medium having an uneven surface such as pulp paper and embossed paper, patterns of dark and light according to the surface conditions of the recording medium P are less likely to appear on the recording medium P. In this case, only the DC voltage is applied as the secondary transfer bias in the first mode. In contrast, when using a recording medium having an uneven surface such as pulp paper and embossed paper, the power source 39 outputs the superimposed voltage, in which the AC voltage is superimposed on the DC voltage, as the secondary transfer bias in the second mode. That is, the power source 39 alternates the secondary transfer bias between the first mode and the second mode, according to the type of the recording medium P to be used (the size of the unevenness on the surface of the recording medium P).

In the image forming apparatus that applies the secondary transfer bias to the secondary-transfer back surface roller 33 with the nip forming roller 36 grounded, when the polarity of the secondary transfer bias is negative so is the polarity of the toner, the toner having the negative polarity is electrostatically pushed out of the secondary-transfer back surface roller 33 to the nip forming roller 36 in the secondary transfer nip N. Accordingly, the toner is transferred from the intermediate transfer belt 31 onto the recording medium P. In contrast, when the polarity of the secondary transfer bias is opposite to that of the toner, that is, the polarity of the secondary transfer voltage is positive, the toner having the negative polarity is electrostatically attracted from the nip forming roller 36 to the secondary-transfer back surface roller 33. Consequently, the toner transferred to the recording medium P is attracted again to the intermediate transfer belt 31.

In the image forming apparatus of the present disclosure, the secondary transfer bias includes a direct current component having the same value as the time-averaged value (Vave) of the voltage applied, that is, a time-averaged voltage value (time-averaged value Vave) of the direct current component. The time-averaged value of the voltage (Vave) refers to a value obtained by dividing an integral value of a voltage waveform over one cycle by the length of one cycle.

When using a recording medium P having an uneven surface, such as Japanese paper (also known as Washi), a pattern of light and dark (unevenness of image density) according to the surface condition of the recording medium easily appears in an output image. In view of the above, instead of applying the DC voltage as the secondary transfer bias, a superimposed voltage, in which the DC voltage is superimposed on the AC voltage, is applied as the secondary transfer bias.

The inventor of the present application has found that when the superimposed bias is applied as the secondary transfer bias, a plurality of voids are likely to occur in images formed in the recessed portions of the recording medium. In US2014/0010562, the inventor has proposed the following: the secondary transfer bias includes a transfer-directional voltage to transfer a toner image from an image bearer side to a recording medium side and a return-directional voltage having a polarity opposite to the polarity of the transfer-directional voltage (hereinafter, referred to as opposite-polarity voltage) to transfer a toner image in a return direction opposite to the transfer direction. Applying the transfer-directional voltage for a longer time period than the opposite-polarity voltage does improve the transferability on paper having an uneven surface. That is, the inventor has proposed that when the time period of application of an opposite-polarity voltage is A and the time period of one cycle of an applied voltage is B, a ratio of A to B is varied.

Further, in US2014/0010562, the occurrence of voids has been verified, and varying the ratio of A to B can suppress the occurrence of voids. The contents of US2014/0010562 is incorporated herein by reference in its entirety. In the present embodiment, the ratio of A to B is a duty cycle.

The inventor of the present application has experimentally found that setting an appropriate value of frequency with the ratio of A to B varied prevents the occurrence of the transfer failure in the recesses of the recording medium P.

The image forming apparatus of the present embodiment changes the frequency of the secondary transfer bias that alternates between the transfer-directional voltage to transfer a toner image from the intermediate transfer belt 31 to the recording medium P and the return-directional voltage having a polarity opposite to the polarity of the transfer-directional voltage. That is, when the time period of application of the opposite-polarity voltage within one cycle of the secondary transfer bias applied is A and the total time period of one cycle of the secondary transfer bias applied is B, the frequency of the secondary transfer bias decreases as the ratio of A to B decreases.

Figure 3:
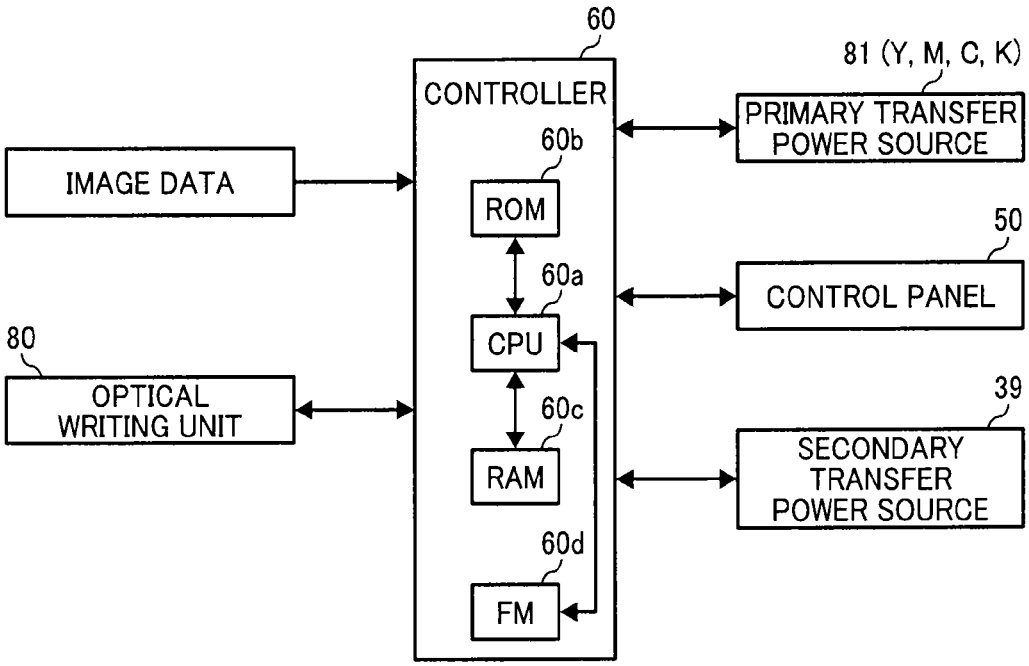
FIG. 3 is a block diagram of one example of a control system of the image forming apparatus of FIG. 1.

FIG. 3 is a block diagram of a portion of a control system of the image forming apparatus 500. In FIG. 3, a controller 60 includes a central processing unit (CPU) 60*a* serving as a computing device, a random access memory (RAM) 60*c* serving as a nonvolatile memory, a read only memory (ROM) 60*b* serving as a temporary storage device, and a flash memory 60*d*. The controller 60 typically includes various constitutional components and sensors communicably connected thereto via signal lines to control the entirety of the image forming apparatus. FIG. 3 illustrates representative components and sensors of the image forming apparatus 500.

A control panel 50 include a touch panel having a screen and a plurality of keys, allowing the screen of the touch panel to display an image. The control panel 50 further receives an input of an operator via the touch panel and keys to send input data to the controller.

Primary transfer power sources 81Y, 81M, 81C, and 81K respectively apply a primary transfer bias to primary transfer rollers 35Y, 35M, 35C, and 35K. A secondary transfer power source 39 outputs a secondary transfer bias to be applied to a secondary transfer nip N. In the present embodiment, the secondary transfer power source 39 applies a secondary transfer bias to a secondary-transfer back surface roller 33. The controller 60 controls the output from the power source 39. In the present embodiment, the controller 60 controls an operation of the entirety of the image forming apparatus 500 to control the output of the power source 39. Alternatively, in some embodiments, another controller 60 controls the output of the power source 39, independently of the controller that controls the entirety of the image forming apparatus.

In the present embodiment, the time-averaged value Vave of the voltage in the alternating current component of the secondary transfer bias is more toward the transfer side than the midpoint voltage value Voff (the center value of the maximum and minimum of the voltage) of the maximum value and the minimum value of the alternating component. To achieve such a relation between the values of Vave and Voff, an area of the waveform on the return-direction side is smaller than an area of the waveform on the transfer-direction side, across the midpoint voltage value Voff of the alternating component. The time-averaged value Vave of the voltage refers to a value obtained by dividing the integral value of the voltage wavelength over one cycle by the length of one cycle. When the maximum value of the applied voltage from the power source 39 is a return-directional peak value Vr and the minimum value of the applied voltage from the power source 39 is a transfer-directional peak value Vt, the difference between the maximum Vr and the minimum Vt of the voltage applied for transfer is a peak-to-peak voltage value Vpp.

Figure 4:
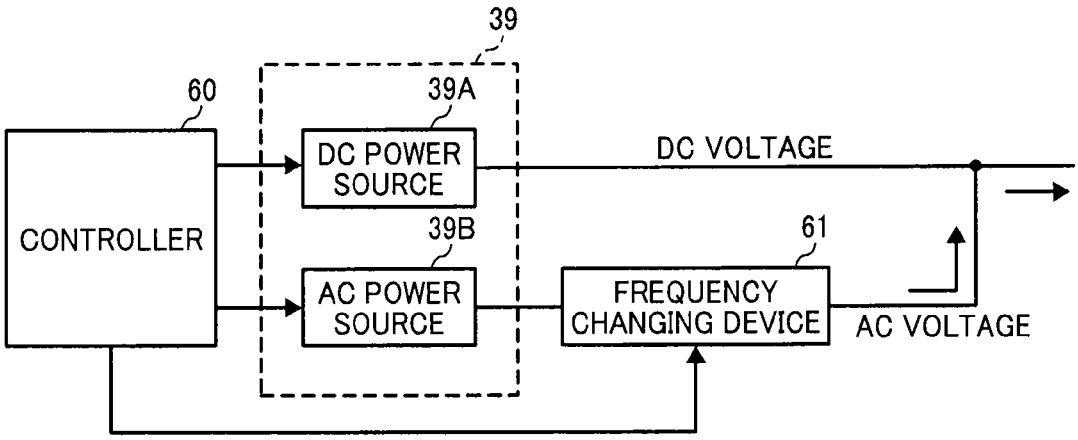
FIG. 4 is a block diagram of one example of change in frequency of a secondary transfer bias.

FIG. 4 is a block diagram of one example of change in frequency of a secondary transfer bias. The image forming apparatus of the present embodiment include a frequency changing device 61 to change the frequency of the voltage output from the power source 39. The power source 39 includes a direct current power source (hereinafter, referred to as a DC power source) 39A and an alternating current power source (hereinafter, referred to as an AC power source) 39B. The AC power source 39B is connected with the output side of the DC power source 39A via the frequency changing device 61, such as an inverter. Each of the DC power source 39A, the AC power source 39B, and the frequency changing device 61 is connected to the controller 60 via a signal line, so that the controller 60 controls each of the DC power source 39A, the AC power source 39B, and the frequency changing device 61. The controller 60 controls the power source 39 to alternate the secondary transfer bias between the DC voltage and the superimposed voltage (the AC voltage is superimposed on the DC voltage). The controller 60 further controls the frequency changing device 61 to change the frequency of the alternating voltage of the secondary transfer bias applied.

Figure 5:
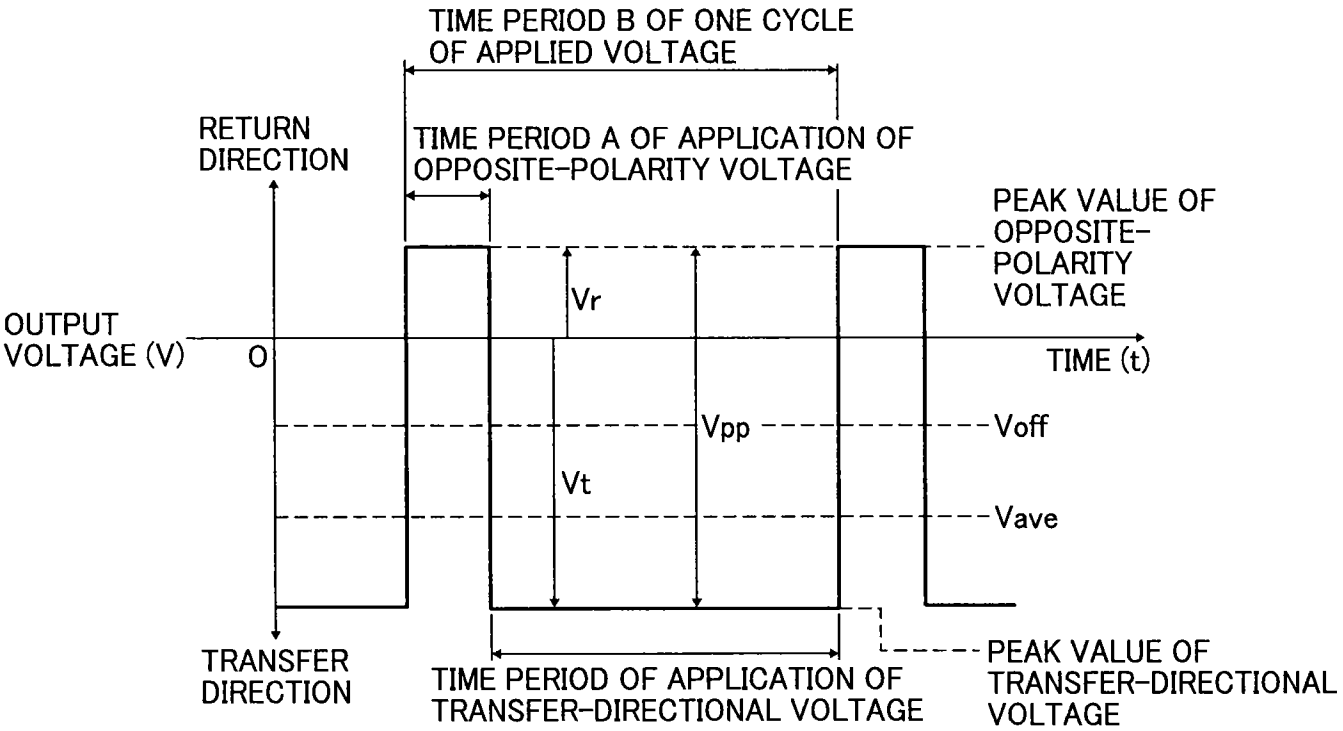
FIG. 5 is a chart of one example of a voltage waveform of a secondary bias output from a secondary transfer power source under control of a controller.

Next, a description is provided of a waveform pattern of output of the power source 39. FIG. 5 is a view of one example of a waveform pattern of the secondary transfer bias. The waveform pattern illustrated in FIG. 5 is a rectangular wave, in which a transfer-directional voltage and a return-directional voltage are alternated. The transfer-directional voltage transfers a toner image from the intermediate transfer belt 31 to the recording medium P. The return-directional voltage has a polarity opposite to that of the transfer-directional voltage to transfer the toner image in a direction opposite to the transfer direction. That is, when the time period of application of the opposite-polarity voltage within one cycle of the voltage applied is A and the total time period of one cycle of the voltage applied is B, the ratio of A to B is variable with changing the value of A.

Experiment 1

Next, a description is provided of a waveform pattern in FIG. 5.

In this experiment, the structure of Imagio MP C7500 manufactured by RICO Company, Ltd. was employed. The secondary transfer bias (voltage for secondary transfer) is externally applied to the image forming apparatus without using a power source disposed therewithin. It should be noted that "Function Generator (FG 300)" manufactured by Yokogawa Electric Corporation is employed as the power source 39 of the secondary transfer bias to form a waveform of a superimposed voltage of the secondary transfer bias, which is then expanded by using "Model 10/40 High-Voltage Power Amplifier" manufactured by Trek, Inc. In addition, "LEATHAC 66" (a trade name, manufactured by TOKUSHU PAPER MFG. CO., LTD.) having a ream weight of 260 kg (a weight of 1000 sheets) and "LEATHAC 66" having a ream weight of 215 kg are used as a recording medium P to have a toner image transferred from the intermediate transfer belt 31. The "LEATHAC 66" has a greater surface roughness than FC Washi type "SAZANAMI" (trade name) manufactured by NBS Ricoh Company, Ltd, does. The "LEATHAC 66" has recessed portions, each having a depth of 100 μm at a maximum.

FIG. 6 illustrates the contents of Comparative Example and Examples 1 and 2. In FIG. 6, five different values are set for the ratio of A to B in each of Comparative Example and Examples 1 and 2.

Comparative Example

In Comparative Example, the value of the ratio of A to B is varied with a constant value of frequency. The frequency is at 1000 Hz.

In Example 1, both of the value of the ratio of A to B and the frequency are varied. In particular, as the value of the ratio of A to B decreases, the value of frequency is gradually decreased from 1000 Hz to 500 Hz.

In Example 2 as well, both of the value of the ratio of A to B and the frequency are varied. In particular, as the value of the ratio of A to B decreases, the value of frequency is decreased within a frequency range smaller than the range of Example 1. In this case, the value of frequency is gradually decreased from 500 Hz to 400 Hz.

FIG. 7 is a table of evaluation of transferability on recording medium having an uneven surface according to Comparative Example, and Examples 1 and 2.

In FIG. 7, "EXCELLENT" and "GOOD" refer to no occurrence of transfer failure. "FAIR" refers to partial occurrence of transfer failure, and "POOR" refers to occurrence of transfer failure out of a permissible range.

As shown in FIG. 7, in Examples 1 and 2, as the ratio of A to B is smaller, more favorable images are obtained. However, in Comparative Example, when the ratio of A to B is less than or equal to a certain value, the transferability deteriorates. In Examples 1 and 2, the transferability improves as the ratio of A to B decreases. Even with ratios of A to B of 0.1 and 0.05, at each of which transfer failure occurs in Comparative Example, successful transferability is obtained.

That is, when the time period of application of the opposite-polarity voltage within one cycle of the secondary transfer bias (referred to as voltage as well) including the superimposed voltage applied is A and the time period of one cycle of the secondary transfer voltage applied is B; as the ratio of A to B decreases, the controller 60 controls the frequency changing device 61 to decrease the frequency of the voltage to be applied, and further controls the power source 39 to output the voltage with a decreased frequency. With such a control of the controller 60, transfer failure is reduced to obtain a favorable image on the recording medium P. Further, when the ratio of A to B is varied, the controller 60 may controls the frequency changing device 61 to change the frequency of the applied voltage and controls the power source 39 to output the voltage with a changed frequency, so as to reduce variation in the value of A.

To vary the ratio of A to B, instead of changing the value of A, the controller controls the frequency changing device 61 and the power source 39 to reduce the frequency of the voltage to maintain a constant value of A. That is, the controller 60 controls the power source 39 to output a secondary transfer voltage for an extended time period to extend the total time period of one cycle of the applied voltage (the value of B) and output a return-directional voltage for a constant time period (a constant value of A). Alternatively, the controller 60 controls the power source 39 to output a transfer-directional voltage for an extended time period within the one cycle.

Experiment 2

The following experiment was performed as well to analyze conditions to exhibit advantageous effects of the present embodiment.

In this experiment, "Imagio MPC 7500" manufactured by RICO Company, Ltd. employed in Experiment 1 was also used as an image forming apparatus, and "LEATHAC 66" was used as a recording medium P. A solid image with an image area ratio of 100% is transferred onto the recording medium P ("LEATHAC 66") with the value of A varied, and the transferability only on the recessed portions of the recording medium P was verified. FIG. 8 shows a ranking of the transferability verified. In FIG. 8, the evaluations of the transferability were graded on a five point scale of 1 to 5, in which higher grade, higher evaluation.

As shown in FIG. 8, when the value of A, i.e., the value of the time period of application of the return-directional voltage is smaller than or equal to a certain value (0.05), the grade of the transferability in the recessed portions falls. This is related to the mechanism of transferability in the recessed portions with the superimposed voltage applied. That is, the mechanism of transferability in the recessed portions is such that toner having been transferred onto a recording medium P is transferred back to the intermediate transfer belt 31 again with an opposite-polarity voltage applied, thereby colliding with each other to reduce a toner adhesion amount. In this mechanism, when the value of A is small (the time period A is short), the time period of application of the opposite-polarity voltage is short as well. In such a case, toner does fully transfer back to the intermediate transfer belt 31 before the transfer-directional voltage is applied, resulting in no occurrence of collision between toner.

As described above, as the value of the ratio of A to B is smaller, the transferability is better. However, when the value of A is too small, the recessed portions are not transferred with toner. Accordingly, the frequency of the AC voltage is reduced to secure a constant value of A, as described above. From the evaluation result in FIG. 8, it is preferable that the length of A is longer than or equal to 0.1 msec.

Embodiments of the image forming apparatus according to the present disclosure are not limited to the image forming apparatus 500 of FIG. 1. The present disclosure can be applied to an image forming apparatus including an intermediate transfer drum of a drum shape, instead of the intermediate transfer belt 31. Further, the present disclosure can be applied to an image forming apparatus including a nip forming belt formed into a belt shape as a transfer device, instead of the nip forming roller 36. Further, the present disclosure can be applied to an image forming apparatus including a transfer roller contacting a photoconductor drum to form a transfer nip, a power source to output voltage to transfer a toner image from the photoconductor drum to a recording medium in the transfer nip, and a controller to control the output of the power source, that is, an image forming apparatus that employs a direct-transfer method.

Figure 9:
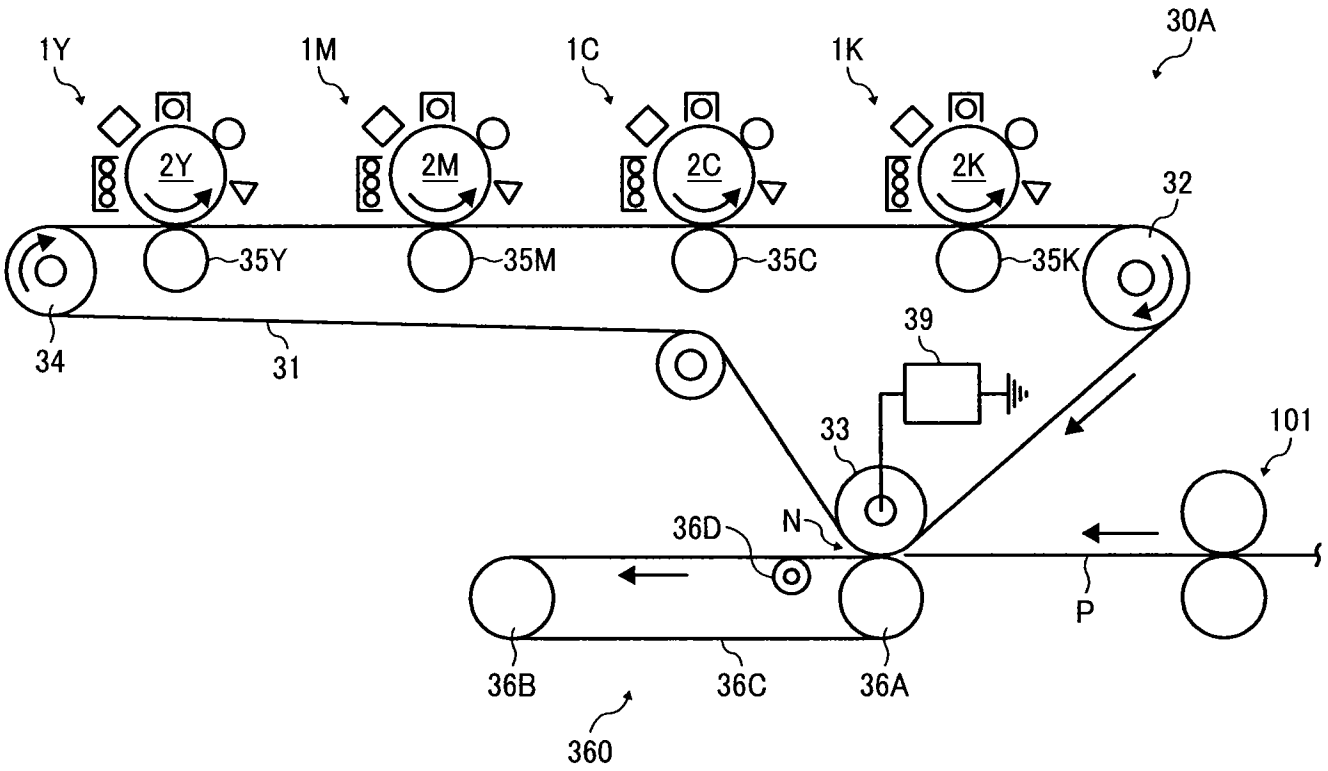
FIG. 9 is an enlarged view of a secondary transfer bias power source and a voltage supplied therefrom in an image forming apparatus according to a second embodiment of the present disclosure.

Next, a description of other embodiments (a second embodiment through a fifth embodiment corresponding to FIG. 9 through FIG. 12, in respective) of the image forming apparatus 500 of the present embodiment is described below. A transfer unit 30A as a transfer device of FIG. 9 is mountable on the image forming apparatus, instead of a transfer unit 30 of FIG. 1. The transfer unit 30A includes an intermediate transfer belt 31 as an image bearer formed into a loop, opposed to image forming units 1Y, 1M, 1C, and 1K, a secondary-transfer back surface roller 33 disposed inside the loop, and a secondary transfer conveyance belt 36C as a transfer device opposed to the secondary-transfer back surface roller 33. In this embodiment, the intermediate transfer belt 31 (FIG. 9) moves in a direction opposite to the moving direction of the intermediate transfer belt 31 in FIG. 1.

The secondary transfer conveyance belt 36C is wound around a drive roller 36A and a driven roller 36B that constitute a secondary transfer conveyance device 360. The intermediate transfer belt 31 contacting the secondary transfer conveyance belt 36C is positioned between the secondary-transfer back surface roller 33 and the drive roller 36A, which contact each other to form a secondary transfer nip N therebetween. The secondary transfer conveyance belt 36C receives and conveys a recording medium P fed to the secondary transfer nip N by registration rollers 101.

In this embodiment, the drive roller 36A is grounded, and the power source 39 applies a secondary transfer bias to the secondary-transfer back surface roller 33. With the secondary transfer bias supplied from the power source 39 to the secondary-transfer back surface roller 33, a secondary transfer electric field is created at the secondary transfer nip N, where the secondary-transfer back surface roller 33 electrostatically transfers a toner image from the intermediate transfer belt 31 to the secondary transfer conveyance belt 36C. In the secondary transfer nip N, the toner image is secondarily transferred from the intermediate transfer belt 31 onto the recording sheet P having entered the secondary transfer nip N.

The embodiment of application of the secondary transfer bias is not limited to the above configuration that applies the secondary transfer bias to the secondary-transfer back surface roller 33. The secondary transfer conveyance device 360 may include a bias supply roller 36D contacting the secondary transfer conveyance belt 36C from the inside of the loop. The bias supply roller 36D is connected to the power source 39, to receive the secondary transfer bias applied from the power source 39.

Figure 10:
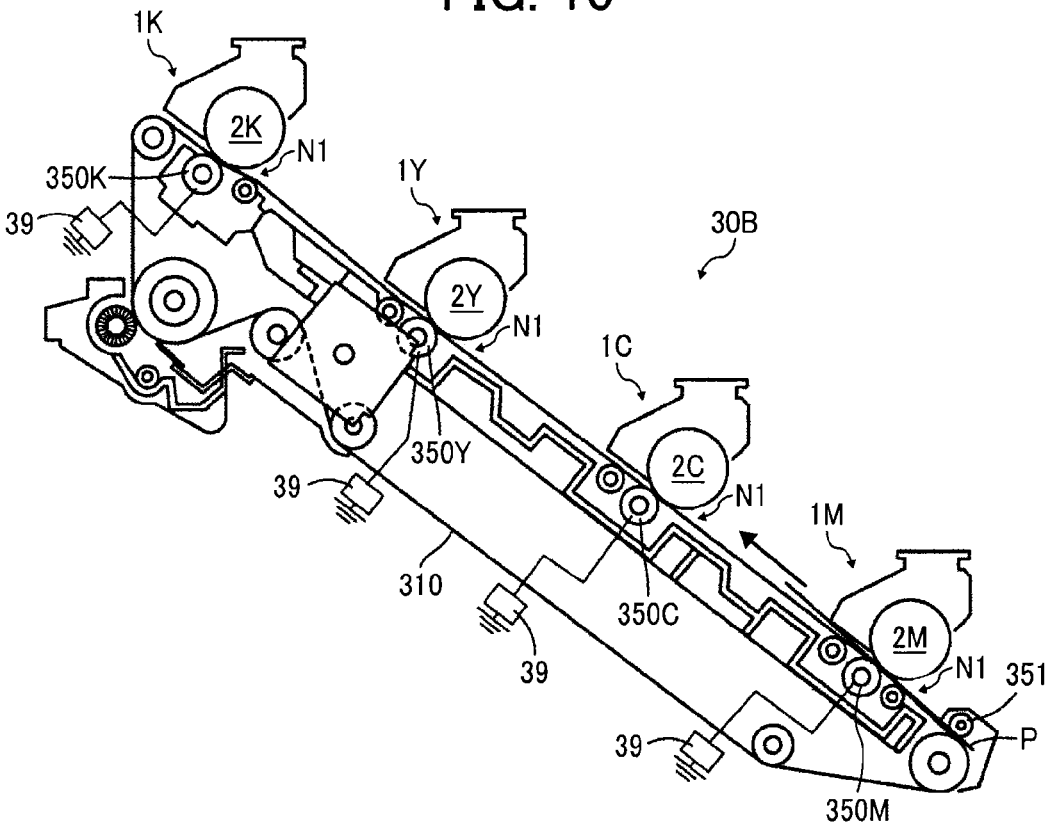
FIG. 10 is an enlarged view of a secondary transfer bias power source and a voltage supplied therefrom in an image forming apparatus according to a third embodiment of the present disclosure.
Figure 11:
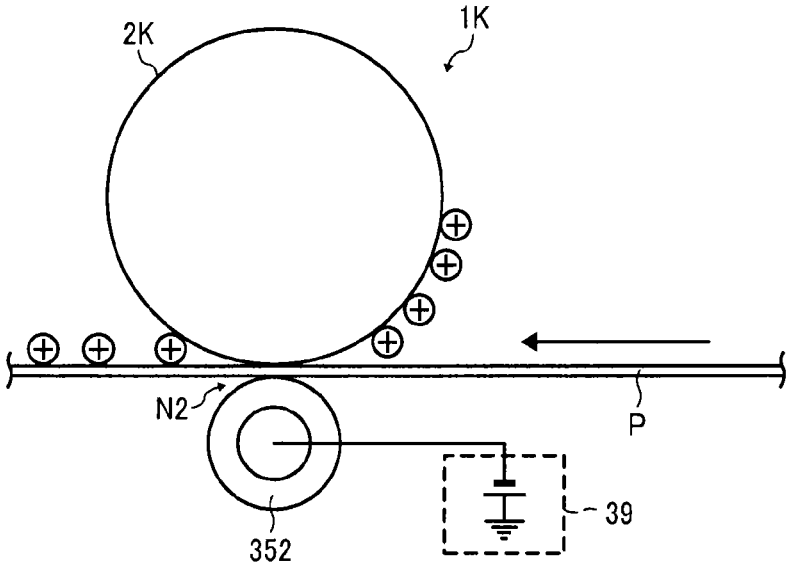
FIG. 11 is an enlarged view of a secondary transfer bias power source and a voltage supplied therefrom in an image forming apparatus according to a fourth embodiment of the present disclosure.

Now, referring to FIG. 10 (the third embodiment of the image forming apparatus), a transfer unit 30B is mountable on the image forming apparatus, instead of the transfer unit 30 of FIG. 1. The transfer unit 30B includes a transfer conveyance belt 310 as a transfer device, opposed to image forming units 1M, 1C, 1Y, and 1K. The transfer conveyance belt 310 is looped around a plurality of rollers. The transfer conveyance belt 310 rotates in the counterclockwise direction to attract a recording medium P fed by a registration roller, to convey the recording medium P toward a transfer nip N1. The transfer conveyance belt 310 further includes transfer rollers 350M, 350C, 350Y, and 350K disposed inside the looped transfer conveyance belt 310, respectively opposed to photoconductors 2M, 2C, 2Y, and 2K. The transfer rollers 350M, 350C, 350Y, and 350K press the transfer conveyance belt 310 against the photoconductors 2M, 2C, 2Y, and 2K. Accordingly, the photoconductors 2M, 2C, 2Y, and 2K contact the transfer conveyance belt 310 to form a transfer nip N1 for each color.

In the present embodiment, the photoconductors 2M, 2C, 2Y, and 2K are grounded. The transfer rollers 350M, 350C, 350Y, and 350K receive transfer bias from the respective power sources 39. Thus, at each of the transfer nips N1 for yellow, magenta, cyan, and black is formed a transfer electric field that electrostatically moves a toner image from each of the photoconductors 2M, 2C, 2Y, and 2K to the transfer roller side.

The recording medium P moves forward from the lower right of the drawing sheet to pass between a sheet attraction roller 351 applied with a bias and the transfer conveyance belt 310, which electrostatically attracts the recording medium P. The recording medium P attracted by the transfer conveyance belt 310 moves to the transfer nip N1 for each color. In each of the transfer nip N1, a composite toner image or a single-color toner image is transferred onto the recording medium P having entered the transfer nip N1 by the secondary transfer electric field and the nip pressure applied thereto, thereby forming a full-color image or a single-color toner image on the surface of the recording medium P.

In the present embodiment, the separate power sources 39 apply the transfer bias to the respective transfer rollers 350M, 350C, 350Y, and 350K. Alternatively, in some embodiments, one power source 39 may applies a transfer bias to the transfer rollers 350M, 350C, 350Y, and 350K.

In the embodiments described above, the description has been provided of the image forming apparatus that forms full-color images. However, the present disclosure is not limited to the image forming apparatus that forms full-color images. For example, FIG. 11 (the fourth embodiment) illustrates a monochrome image forming apparatus, in which an image forming unit 1K for black includes a photoconductor 2K for black, opposed to a transfer roller 352 as a transfer device. The present disclosure may be applied to such a monochrome image forming apparatus according to the fourth embodiment.

The transfer roller 352 is constituted of a cored bar made of, for example, stainless steel and aluminum, having a resistance layer of a conductive sponge on the cored bar. The resistance layer may have a surface layer made of fluororesin.

The transfer roller 352 contacts the photoconductor 2K to form a transfer nip N2 between the transfer roller 352 and the photoconductor 2K. In this embodiment, the photoconductor 2K is grounded. The transfer roller 352 receives transfer bias from a power source 39. Thus, between the transfer roller 352 and the photoconductor 2K is formed a transfer electric field that electrostatically moves a toner image from the photoconductor 2K to the transfer roller 352 side. That is, the toner image is transferred from the photoconductor 2 onto the recording sheet P having entered the transfer nip N2 by the transfer field and the nip pressure.

Figure 12:
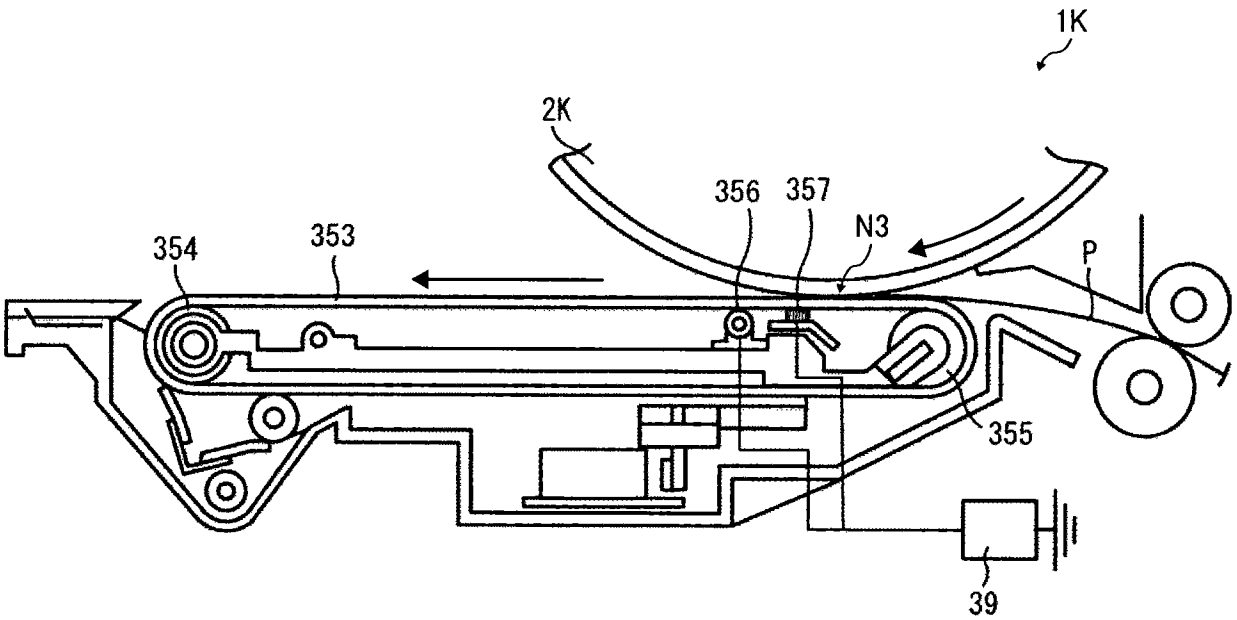
FIG. 12 is an enlarged view of a secondary transfer bias power source and a voltage supplied therefrom in an image forming apparatus according to a fifth embodiment of the present disclosure.

Next, referring to FIG. 12 (the fifth embodiment), an image forming apparatus according to the fifth embodiment includes a transfer conveyance belt 353 as a transfer device, contacting one photoconductor 2K opposed to the transfer conveyance belt. The transfer conveyance belt 353 is wound around and stretched taut around a drive roller 354 and a driven roller 355, the transfer conveyance belt 353 rotating in a direction illustrated in FIG. 12. The transfer conveyance belt 353 partially contacts the photoconductor 2K between the drive roller 354 and the driven roller 355, to form a transfer nip N3. The transfer conveyance belt 353 receives and conveys a recording medium P being delivered to the transfer nip N3.

Inside the loop of the transfer conveyance belt 353 are disposed a transfer bias roller 356 and a bias brush 357. The transfer bias roller 356 and the bias brush 357 contacts the inner surface of the transfer conveyance belt 353 at downstream of the transfer nip N3 in a direction of movement of belt.

In the present embodiment, the photoconductor 2K is grounded. The transfer bias roller 356 and the bias brush 357 receives transfer bias applied from the power source 39. Accordingly, at the transfer nip N3 is formed a transfer electric field that electrostatically moves a toner image from the photoconductors 2K to the transfer conveyance belt 353 side. In the transfer nip N3, the toner image is transferred, by the transfer electric field and the nip pressure, from the photoconductor 2K onto the recording sheet P, which has been conveyed by the transfer conveyance belt 353 and has entered the secondary transfer nip N3.

In the image forming apparatus of the present embodiment, both of the transfer bias roller 356 and the bias brush 357 are disposed contacting the transfer conveyance belt 353. The present disclosure is not limited to the present embodiment. The image forming apparatus does not necessarily include the combination of the transfer bias roller 356 and the bias brush 357, and either one of the transfer bias roller 356 and the bias brush 357 may be included in some embodiments. Alternatively, in some embodiments, the transfer bias roller 356 and the bias brush 357 may be disposed below the transfer nip N3.

In the second embodiment of FIG. 9 through the fifth embodiment of FIG. 12, a controller 60 controls the power source 39 to output a secondary transfer bias (or a transfer bias) including a superimposed voltage such that the frequency of the secondary transfer bias to be output decreases as the ratio of A to B decreases. In this case, the time period of application of the opposite-polarity voltage within one cycle of the secondary transfer bias (the transfer bias) applied is A, and the total time period of one cycle of the secondary transfer bias (the transfer bias) applied is B.

Although the embodiments of the present disclosure have been described above, the present disclosure is not limited to the embodiments described above, but a variety of modifications can naturally be made within the scope of the present disclosure The image forming apparatus of the present disclosure is not limited to a printer. The image forming apparatus includes, but is not limited to, a copier, a printer, a facsimile machine, and a multi-functional system including a combination thereof.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image bearer configured to bear a toner image;

a transfer device configured to contact the image bearer to form a transfer nip;

a transfer bias power source configured to output an output voltage to transfer the toner image from the image bearer onto a recording medium in the transfer nip; and a controller configured to control the transfer bias power source, wherein the transfer bias power source is configured to output the output voltage that alternates between a transfer-directional voltage and a return-directional voltage, to transfer the toner image from the image bearer to the recording medium, the transfer-directional voltage having a polarity to transfer the toner image from the image bearer to the recording medium and the return-directional voltage having an opposite polarity to the polarity of the transfer-directional voltage, and wherein the controller is configured to reduce a frequency of the output voltage as a ratio of A to B decreases, where A is a time period of application of the return-directional voltage within one cycle of the output voltage, and B is a time period of the one cycle of the output voltage.

2. The image forming apparatus according to claim 1, wherein the controller is configured to reduce the frequency of the output voltage to maintain a value of A constant while changing the value of the ratio of A to B.

3. The image forming apparatus according to claim 1, wherein the controller is configured to change the frequency of the output voltage to reduce variation in a value of A while changing the value of the ratio of A to B.

4. The image forming apparatus according to claim 1, wherein a length of the time period of application of the return-directional voltage within the one cycle of the output voltage is configured to be longer than or equal to 0.1 msec.

5. The image forming apparatus according to claim 1, further comprising a frequency changing device configured to change the frequency of the voltage output from the transfer bias power source, wherein the controller controls the frequency changing device to change the frequency of the output voltage.

6. The image forming apparatus according to claim 1, wherein the transfer bias power source is configured to output a superimposed voltage, in which a direct current component is superimposed on an alternating current component.

* * * * *